US006719289B1

(12) United States Patent
Brown et al.

(10) Patent No.: US 6,719,289 B1
(45) Date of Patent: Apr. 13, 2004

(54) DICON GAME BOARD AND SYSTEMS OF PLAY

(76) Inventors: Stephen W. Brown, 131 Abundant Life Dr., Auburndale, FL (US) 33823; Louise Marie Brown, 131 Abundant Life Dr., Auburndale, FL (US) 33823; Mary Lou Brown, 131 Abundant Life Dr., Auburndale, FL (US) 33823

( * ) Notice: Subject to any disclaimer, the term of this patent is extended or adjusted under 35 U.S.C. 154(b) by 0 days.

(21) Appl. No.: 10/251,175

(22) Filed: Sep. 20, 2002

Related U.S. Application Data

(63) Continuation-in-part of application No. 09/904,142, filed on Jul. 13, 2001.

(51) Int. Cl.[7] ..... A63F 3/02

(52) U.S. Cl. ..... 273/260; 273/241; 273/261; 273/280; 273/282; 273/283

(58) Field of Search ..... 273/261, 260, 273/283, 241, 280, 282

(56) References Cited

U.S. PATENT DOCUMENTS 4,093,237 A * 6/1978 Weiss ..... 273/260
4,200,293 A * 4/1980 Benson, III ..... 273/260
4,546,981 A * 10/1985 Elizondo ..... 273/260
5,011,159 A * 4/1991 Fortunato et al. ..... 273/260
5,570,887 A * 11/1996 Christie, Jr. ..... 273/261
6,116,602 A * 9/2000 McLoy ..... 273/261
6,120,029 A * 9/2000 Carmichael et al. ..... 273/260
6,142,474 A * 11/2000 Tachkov et al. ..... 273/260
6,382,626 B1 * 5/2002 Ryff ..... 273/260

* cited by examiner

*Primary Examiner*—Benjamin H. Layno
*Assistant Examiner*—Dolores R. Collins
(74) *Attorney, Agent, or Firm*—Brian S. Steinberger; Law Offices of Brian S. Steinberger, P.A.

(57) ABSTRACT

A two-player board game of chance and strategy, that uses sixteen direction-oriented game pieces, and fifty Additional Movement playing cards on a chess-like playing board. Each player is dealt seven or eleven cards, all concealed from view with only one card revealed during play. The game piece movements are used to capture or position the game pieces (1), for capture splays. The six different types of direction-oriented game pieces and their attributes change direction each time they reach the limits of the board on either opposing side. When a card is played, both the standard game piece movement and the matching card's movement (2) are taken together and represent one extended move (3,4). The game is won-by capturing the opponent's Lion type game piece. Additional variations include a four-player version and Level-Four Play.

27 Claims, 22 Drawing Sheets

DICON GAME BOARD AND SYSTEMS OF PLAY

This invention relates to board games, and more specifically to a board game apparatus and methods of play including playing pieces that are moved to position or to capture additional pieces, use of playing cards for adding additional movements to the pieces, all that can be used for two to four players and additional play skill levels, and this invention is a Continuation-In-Part of U.S. patent application Ser. No. 09/904,142 filed on Jul. 13, 2001.

BACKGROUND AND PRIOR ART

The game of chess is a two-player board game played upon an eight square by eight square game board. In chess there is a plurality of sixteen game pieces. In chess the game pieces are set up on the first two rows of each player's side. In chess there are six different types of game pieces, each of which has it's own unique set of movements. In chess, turns alternate between the two opposing black and white game pieces. In chess, the game pieces represent a hierarchy of power within a feudal system were lesser empowered game pieces are expendable, strategically used to force moves of the opponent's higher-ranking game pieces.

Chess is an intriguing game but does not work well with the concept of one board with overlapping layers of playing fields. Chess has many complicated rules and movements, and virtually no element of chance.

A large number of chess games, chess-like games, expanded chess, enlarged and unique shaped game boards have been proposed over the years. There are some chess-like games, of which have been issued patents, where there exists an element of chance, concealment, change in direction, or control of multiple sets of game pieces.

U.S Pat. No. 4,546,981 to Elizondo describes a checkers or chessboard with detachable strips that could be turned one hundred-eighty degrees thus changing the direction of the game pieces where they reside.

U.S Pat. No. 4,093,237 to Weiss describes a two to four-player chess-like game whereby the initial setup of the game pieces were concealed by placement of blinders in front of each player's game pieces.

U.S. Pat. No. 5,011,159 to Fortunato et al. describes a chess game involving dice as a chance element and money.

U.S. Pat. No. 5,570,887 to Christie, Jr. describes a medieval military conflict board game for two to four-player whereby said game uses dice and different decks of cards as elements of chance. The cards are drawn and consist of, magic cards, lair cards, guardian cards, ancient relic cards, and defeated playing piece markers. The cards provide instructions during the play of the game.

U.S. Pat. No. 6,116,602 to McLoy describes a four-player chess game whereby the object is to eliminate the opposing kings and checkmate the last king. The game is played in teams or singles. In singles play, an opposing king is checkmated whereby all the conquered player's game pieces are removed from the board. This is done until only two players remain and one of the kings is checkmated.

U.S. Pat. No. 6,120,029 to Carmichael et al. describes an educational game for teaching chess that can use playing markers and chess type dice and cards that requires the winner be the player who scored the most captured chess pieces.

U.S. Pat. No. 6,142,474 to Tachlov et al. describes a two to four-player chess-like game whereby alliances may be formed and dissolved, and one army may control other armies.

The above patents are generally variations of chess in one way or another, that require sophisticated instructions that significantly add to the existing instructions of chess type play with or without additionally physical objects such as blinders and dice. None of these games applies the combination of a game having the sophistication of chess, yet is simpler to play than chess and has greater unpredictability than chess.

SUMMARY OF THE INVENTION

A primary objective of the invention is to provide a game board with playing pieces and methods of play that is as sophisticated as chess, has greater levels of chance and unpredictability and is simple to play.

A secondary objective of the invention is to provide a game board such as a chess board with playing pieces and methods of play using playing cards that are combined with the movements of the playing pieces for use with two to four players.

A third objective of the invention is to provide a game board such as a checkers board with playing pieces and methods of play using playing cards that are combined with the movements of the playing pieces for use with two to four players.

A fourth objective of the invention is to provide a game board such as an eight by eight grid with playing pieces and methods of play using playing cards that are combined with the movements of the playing pieces for use with two to four players.

DiCon was initially conceived as a game idea of a multi-layered overlay graph. The idea of multiple overlays then was adapted for board game use, theorizing that games could be played on one game board but on several virtual-overlay levels as long as the game is broken into individual elements.

By using virtual-overlays, called Planes of Play, to formulate the game and explain the travel of direction oriented game pieces, DiCon can be a complex game with simple rules. The use of Alternate Movement Cards brings an element of chance to the game. The complexity of the game increases as the number of players and as the options increase, thereby giving players the chance to increase to higher levels of skill.

The name, DiCon, is derived from Di, which means two; and con, which has several meanings but is used in the context of, to study or to deceive. The Di part of the DiCon, represents the two virtual layers of thought that must be maintained, pertaining to the game-piece orientation and movements, and the orientation of the Additional Movement Cards. The Con part of DiCon, represents the deception and study part, whereby the concealed cards and individual game piece movements are used to form a strategy of play.

DiCon is not a chess game but has some similarities. The type of game board in DiCon is similar to chess. In chess and DiCon there is a plurality of sixteen game pieces. In chess and DiCon there are six different types of game pieces each of which has a unique set of standard movements. In chess and DiCon, turns alternate between the two opposing colors of game pieces.

DiCon has a plurality of sixteen game pieces that are unlike chess pieces in that they have a front and a back, and the moves have orientation that is directly related to the facing direction of the game piece. When a game piece reaches the limits of the play board, on the facing opponent's camp, the game piece is turned around to face the opposite direction. When the game piece is turned around, the game piece 'standard movements, of which are oriented to the direction the game piece is facing, are also turned around.

There is a chance element of up to 50 cards, where each player is dealt seven or eleven cards, forty-nine of which represent an additional single-space movement in one of eight different directions; or the Swap card is used. Dealing the cards is done by alternately dealing rounds of cards to the players. The card hand is concealed from the opponents, only to reveal a card when it is played. The orientation of the movement in which the card represents is always oriented to the view of the player who plays the card, even if the direction of selected game piece has changed.

In the two-player game, the player who does not deal the cards makes the first board move. In the four-player game, the player to the left of the dealer makes the first board-move. The turns at dealing of cards is done in a clockwise fashion as well.

In DiCon, the game pieces represent a hierarchy of power within a professional military type system whereas no game piece is expendable and even the perceived least powerful game pieces may win the game. The focus of play is from the perspective of the warrior, not the ruler's view. The game piece movements are not forced by sacrifice. When the cards are dealt, each player, making use of the Additional Movement Cards, forms strategies to capture opposing game pieces. The use of this element of surprise, when a game card is played, makes any game piece formidable.

The four-player game has a larger fourteen by fourteen square play-board and uses a quadruple of sixteen game pieces, each set of sixteen being of a different color. This expansion of the game to a four-player board does not change the basic rules of the game, however additions are added to the rules. The object of the four-player game is to win by being the player with the only Lion game piece left. When an opponent's Lion game piece is captured, that player is out of the game; and the conquered opponent relinquishes all of his or her game pieces and cards to the conquering player. The conquered game pieces remain in their original positions whereby the conquering player controls said pieces. One player can control his or her own game pieces and cards, and up to two conquered armies each of which travels on their own Plane of Play.

Unlike chess, DiCon strategies cannot be predicted too many moves ahead. A player's long thought out strategies can be dashed as easily as the presentation of a card.

The subject invention is unique in many ways: The unpredictability of DiCon combines, game piece movements and card plays, the special game piece attributes that are aligned with the facing direction of the game pieces, the addition of the concealed Additional Movement Cards of chance, and the ease of expandability, to make DiCon a unique game.

In a brief summary of the figures DiCon is a game of chance, strategy, and skill of which uses a chess-like play board, a plurality of sixteen game pieces of which are two colors and fifty playing cards. The game pieces are arranged in the first two rows of each player's side, FIG. 1. Each of the six types of game pieces have individual restricted movements of play of which are unique to that type of piece, FIGS. 3–8. Each game piece has a front and back of which indicates the facing direction and orientation of the standard movements of each individual game piece, FIG. 2. Each type of game piece, except the Lion, is represented by a set of eight cards, each of which indicates an additional single space movement in one of eight directions radiating from a central square of a three by three square grid on each card, FIGS. 9–13. The additional movement provided by any of these facsimile or theme cards translates directly to the game piece square on the game board, as would the directional arrow within the central square of the three square by three square grid illustrated on the face of the presented card. The game piece is then moved as per the illustration on the card one square in the direction of the pointing arrow. The orientation of a card when it is presented is always to the view of the presenter and his or her original seating position at the game board, FIG. 16. There is a Wild card, as in FIG. 15; a Swap card, as in FIG. 14; and an additional set of eight cards representing the Ram game piece. The increased number of game cards for the Ram game piece increases the Ram's effectiveness in the game. Each player is dealt an equal number of seven or eleven cards. The cards are concealed from view of the opponent or opponents only to reveal a single card when it is played. The object of the game is to position the game pieces on the play board by using the standard game piece movements thereby capturing the opponent's game pieces by use of an additional movement card or by the standard movements alone, as in FIGS. 17–21. The limitations of the movements of the individual game pieces are extended when a card is played thereby surprising the opponent with an extended movement and capturing the opponent's game piece. There are two choices when an additional movement card is played: Take the card movement first or take the standard game piece movement first. The choice depends greatly on whether the path to a destination square is blocked in one direction but not another. The Swap card is unlike the other forty-nine cards in that two game pieces of the same color may be swapped; then the standard game piece movement is taken with one of those swapped pieces. The luck of the card deal determines, in great part, the strategy a player will formulate to capture game pieces and win the game. Most game piece movements are made without the use of the cards and in fact an entire game can be played without the use of the cards. The cards, however, make playing the game more intriguing, intense, and personal.

The four-player game of DiCon uses a fourteen square by fourteen square grid or checkered type board, as in FIG. 22. Cards are dealt and turns are taken in a clockwise fashion. The player directly to the left of the dealer moves first. Each player has set of sixteen game pieces, each set of which is of a different color. The play of a four-player game is no different than the play of a two-player game until one player captures another player's Lion game piece. When another player's Lion game piece is captured, the conquered player relinquishes his or her game pieces and playing cards to the conquering player. The conquered player is out of the game. The board position of the conquered game pieces does not change nor are the game pieces removed. The conquering player, from that point, takes the regular rotating turns that the conquered player would be taking as if that person were still there. The conquering player from his or her original seating position directs any moves made with the conquered game pieces. Any cards played must be oriented to the view of the conquering player from his or her original seating position, even if the cards being played came from the conquered player, as in FIG. 16. One player can control as many as three sets of game pieces during a four-player game.

An extra option for the four-player game is to play as Level Four Player game, whereby any game piece that reaches the limits of the game board on any of the four sides, will be turned to face the inner part of the game board, thereby said game piece changes its Plane of Play, yet retains the game piece attributes as before. A Plane of Play is a term referring to the facing direction of travel of an individual game piece. In the four-player game there are four Planes of Play. If this option is chosen, then any player can have game pieces of their original set traveling on all four Planes of Play. When this option is chosen, conquered sets of game pieces and cards can lead to a more complicated game of two or three sets of game pieces traveling on four Planes of Play, all controlled by a single player.

Additionally options can be used for either the two or four-player games. One option is whether to set up the game pieces in any arrangement of order on the first two rows of each player's home camp. Another option is whether to deal seven or eleven cards to each player. All options should be agreed upon before setting up the game board and dealing the cards to each player.

In both the two-player and four-player versions, the object of the game is to have the only Lion game piece left on the board. As players become skillful in the two-player game, they can transition to the four-player game; and then again to become Level Four Players.

In the invention and in war, the effectiveness of the warriors(basic game pieces) is to protect their commander, the Lion game piece, and pursue a victory, is bound by chance, strategy, and skill. The expansion of the warrior's movements in the subject invention is a departure from chess and the feudal system it represents. DiCon represents a view of war where sacrifice of less powerful pieces is not encouraged as it is in chess. The game of DiCon represents the warrior's view of war.

Further objects and advantages of this invention will be apparent from the following detailed description of a presently preferred embodiment which is illustrated schematically in the accompanying drawings.

DESCRIPTION OF THE PREFERRED EMBODIMENTS

Before explaineing the disclosed embodiments of the present invention in detail it is to be understood that the invention is not limited in its application to the details of the particular arrangements shown since the invention is capable of other embodiments. Also, the terminology used herein is for the purpose of description and not of limitation.

Figures 1, 1A, 1B:
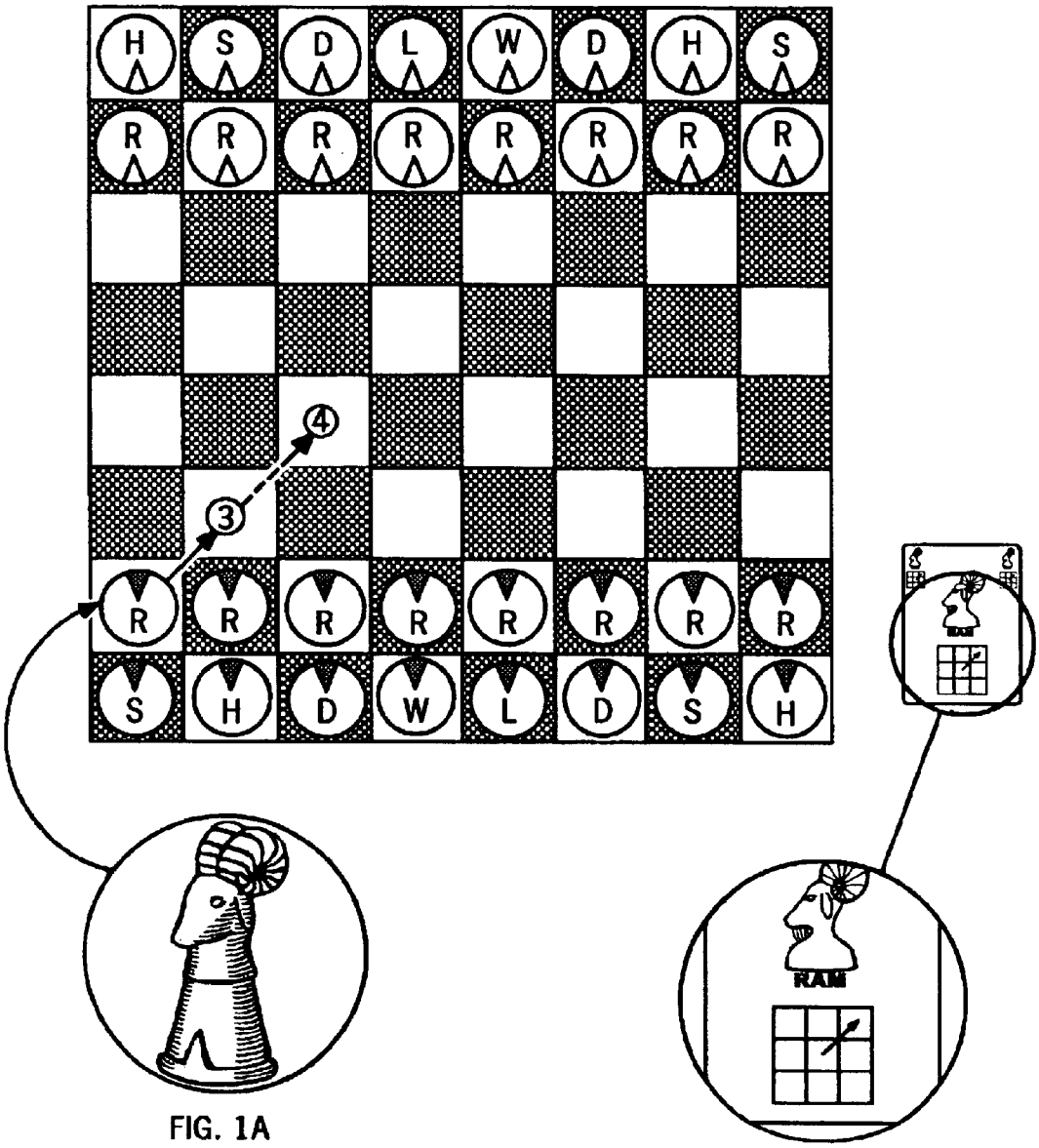
FIG. 1 is an overhead view of the two-player game board illustrating a game piece setup for two players with additional player piece movement card.
FIG. 1A shows an enlarged view of a three-dimensional Ram game piece in FIG. 1.
FIG. 1B shows the enlarged detail of a Ram Additional Movement Card used in FIG. 1.

Referring to the drawings wherein the two-player game board, with game pieces, as illustrated in FIG. 1, can be used on one of: a chess board, a checkers board and an eight by eight grid. The surface can include sixty-four equal sized squares of two alternating colors, arranged in eight columns and eight rows, thereby creating a checkered effect. A preferred setup for a two-player game is illustrated in FIG. 1. The two-player game can be played on a checkers board, chessboard, chess-table, or eight by eight grid. Game boards can be made of almost any durable material.

The term, Home Camp, used in the detailed description refers to the originating game board side of each set of game pieces as related to the players who controls the game pieces at the beginning of a new game.

Referring to the game board a list of definitions will now be provided:

Destination Square is the square a game piece ends upon after the completion of a selected game piece movement.

Path refers to the squares a game piece travels to get to the destination square.

Blocked Path refers to movement that cannot be taken if the path to a destination square is occupied by another game piece.

Jump to Destination refers to the movement of a game piece whereas the blocking of the path does not apply. The only game piece with attributes of Jumping is the Snake game piece; and the only card movement of a game piece that falls into this Jump status is the Swap card.

Capture refers to the action a player takes to displace and remove an opponent's game piece upon landing on an occupied square. No two game pieces may occupy the same square.

Blocked Destination refers to a movement that shall not be taken if the destination square is occupied by a game piece of the person making the game piece move.

Rotation refers to the required action a player must take to rotate his or her game piece one hundred-eighty degrees to face the inner portion of the game board when said game piece reaches the limits of the game board of either facing, opposing player. A player's game piece can reach the limits of the game board and rotate said game piece as many times as necessary.

Impasse refers to a condition in game play when no player's game pieces have a legal move, thereby voiding the game, whereas said game is restarted.

Plane of Play refers to the direction of travel, of direction oriented game pieces of each player, whereas the game pieces of different players travel on the same board on overlapping layers of play. Win occurs when one player has the only Lion game piece left on the game board.

Referring to FIGS. 1–8, there can be sixteen game pieces for each player. Of each sixteen pieces there can be six different types of game pieces, each with a different set of standard game piece movements, as in FIGS. 3–8. The different types and number of game pieces for each set of sixteen can be as follows:

Eight Ram game pieces, which represent the frontline warriors.

Two Hammer game pieces, which represent the marksmen.

Two Snake game pieces, which represent stealth warriors.

Two Defender game pieces, which represent elite guards.

One Wolf game piece, which represents the Lieutenant or second in command.

One Lion game piece, which represents the Commander or General

Figure 2:
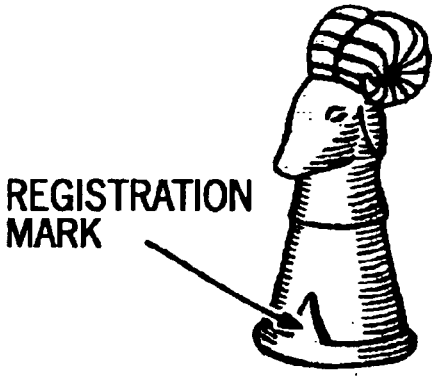
FIG. 2 illustrates a Ram game piece with the registration mark on the front of the piece.
Figure 3:
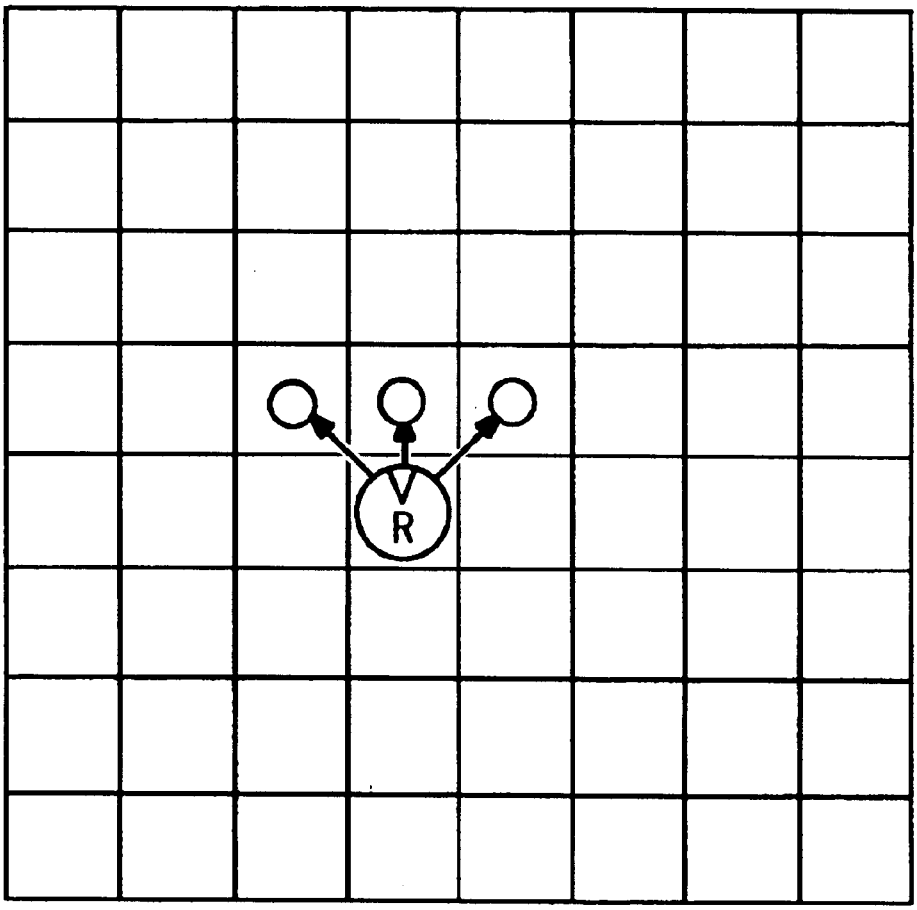
FIG. 3 illustrates the three, standard, individual game piece movements of the Ram game piece, denoted by the "path" with arrows, "destination" of small circles, large circle representation for game piece origin and triangle registration mark on front the piece.
Figure 4:
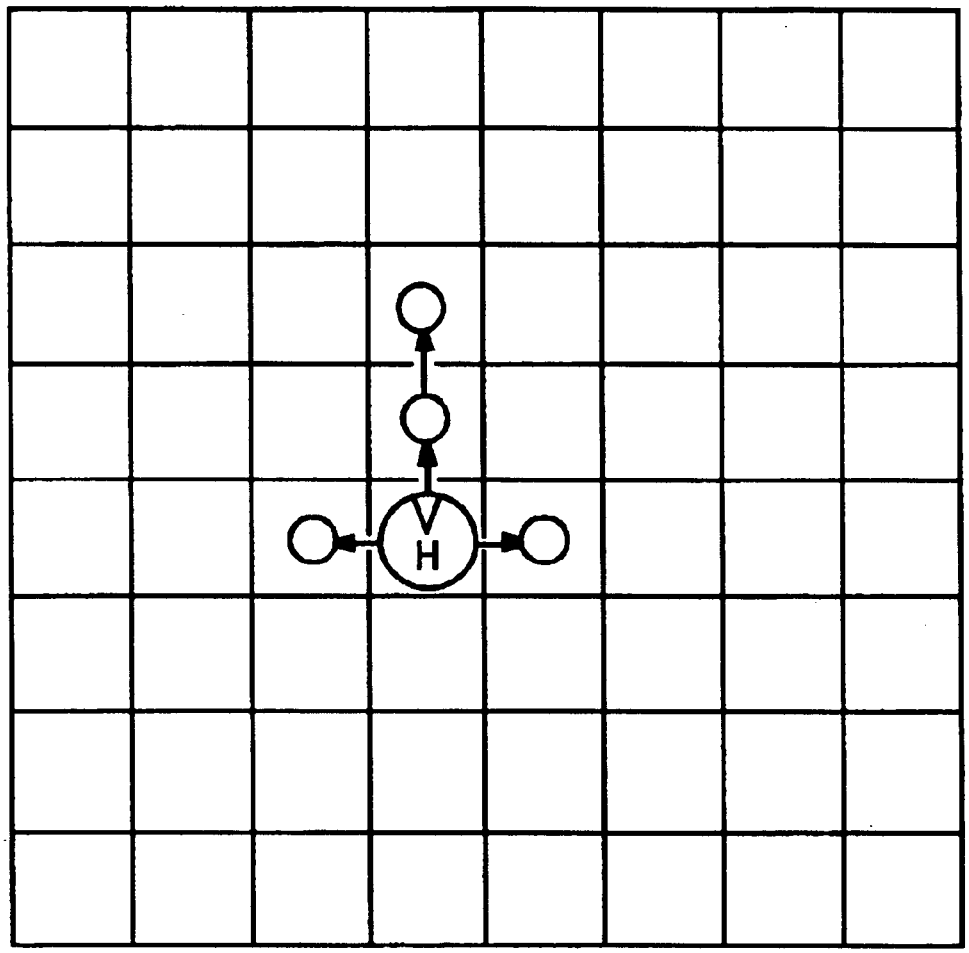
FIG. 4 illustrates the four, standard, individual game piece movements of the Hammer game piece, denoted by the "path" with arrows, "destination" of small circles, large circle representation for game piece origin and triangle registration mark on front the piece.
Figure 5:
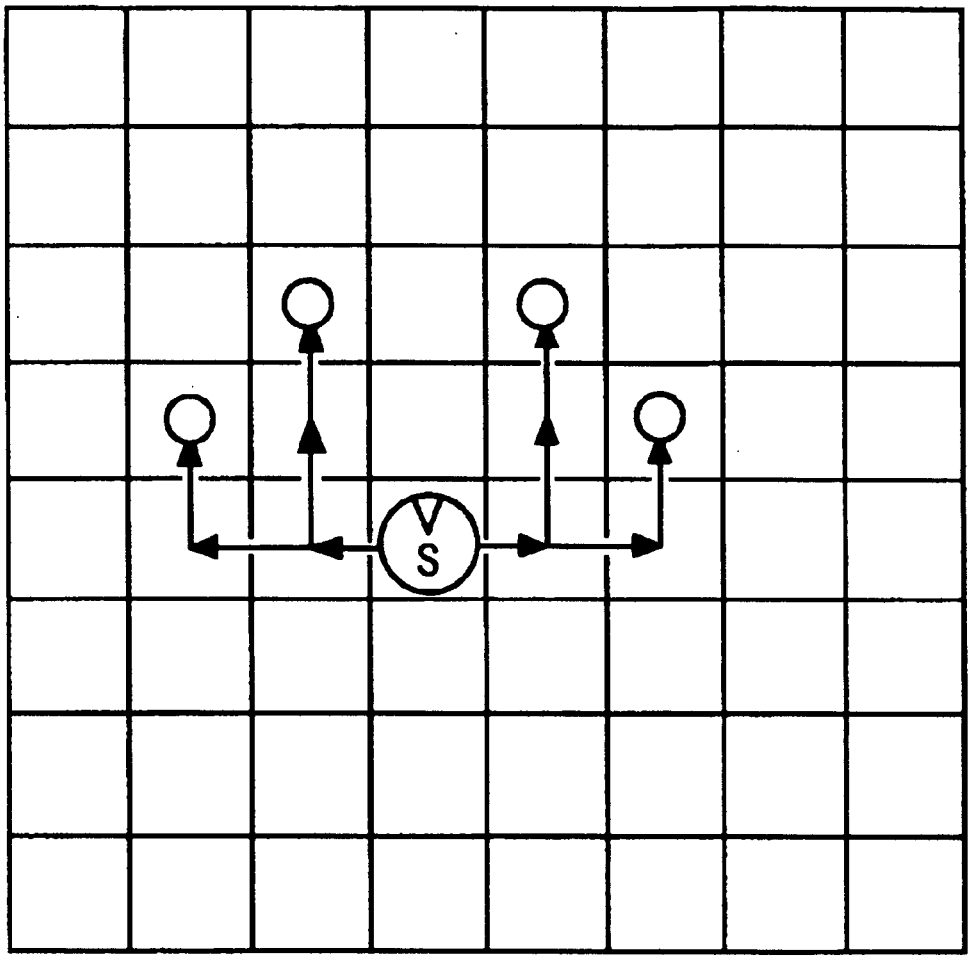
FIG. 5 illustrates the four, standard, individual game piece movements of the Snake game piece, denoted by the "path" with arrows, "destination" of small circles, large circle representation for game piece origin and triangle registration mark on front the piece.
Figure 6:
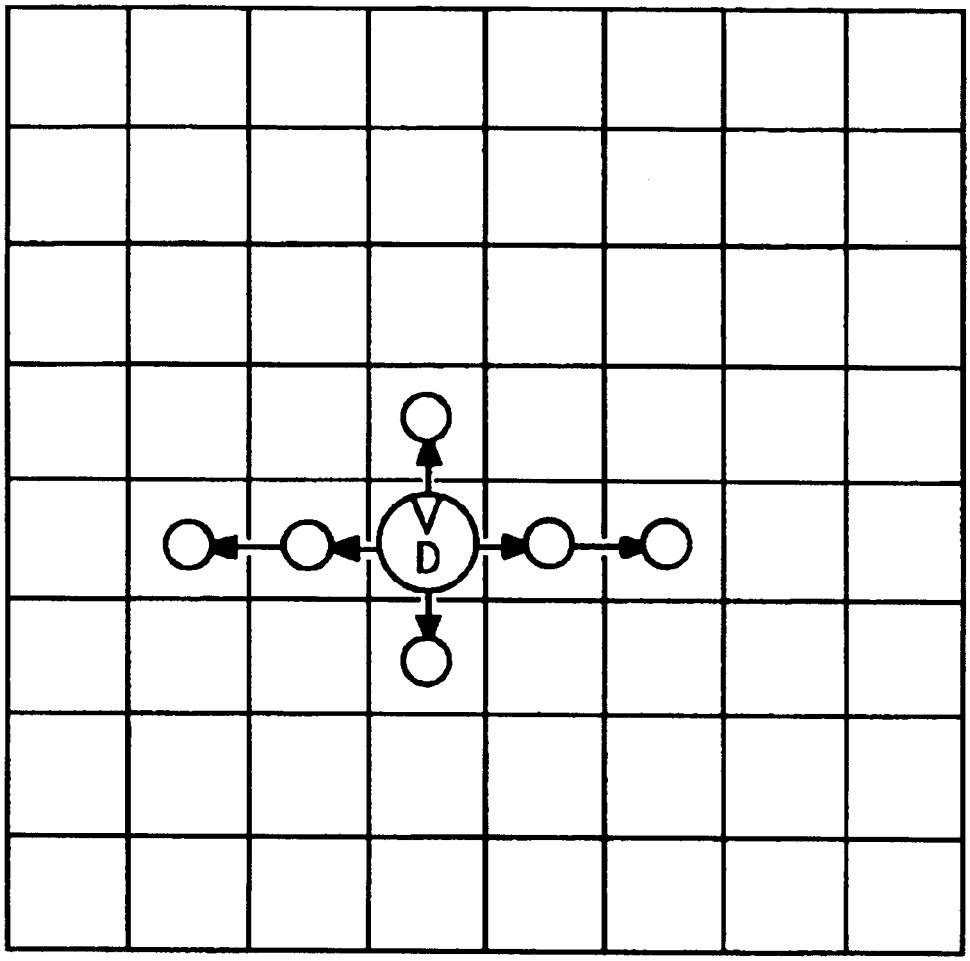
FIG. 6 illustrates the six, standard, individual game piece movements of the Defender game piece, denoted by the "path" with arrows, "destination" of small circles, large circle representation for game piece origin and triangle registration mark on front the piece.
Figure 7:
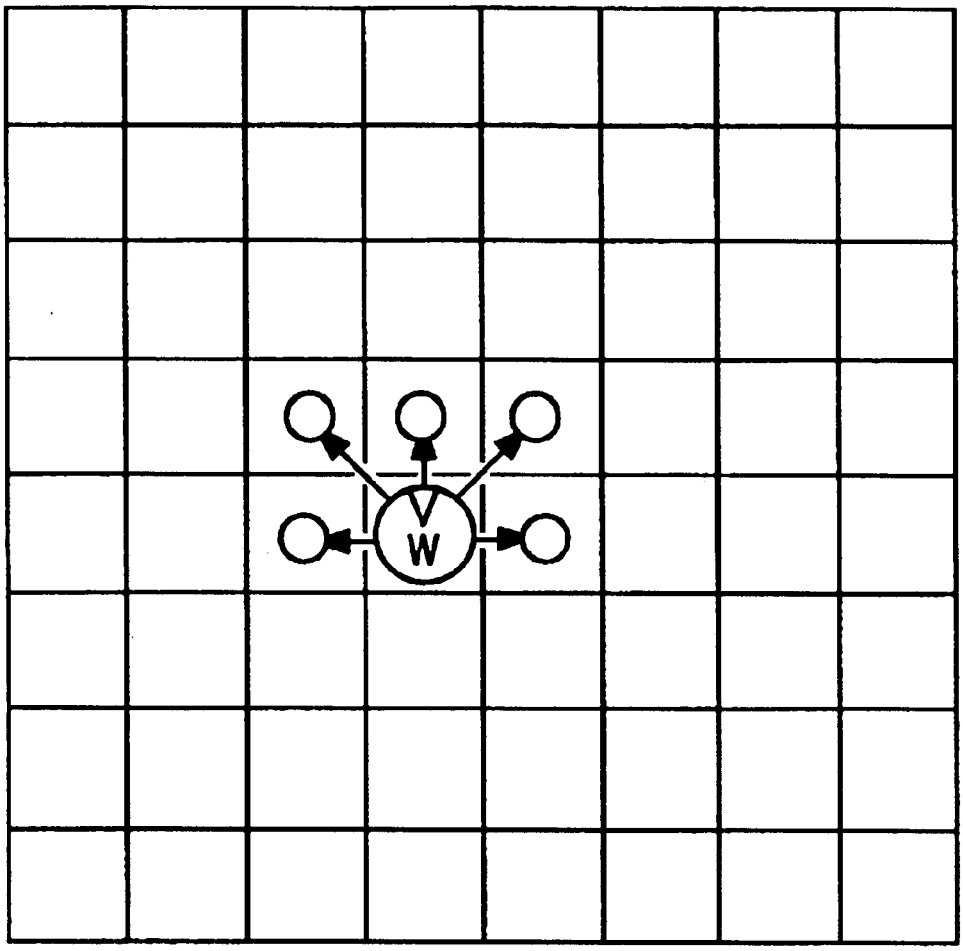
FIG. 7 illustrates the five, standard, individual game piece movements of the Wolf game piece, denoted by the "path" with arrows, "destination" of small circles, large circle representation for game piece origin and triangle registration mark on front the piece.
Figure 8:
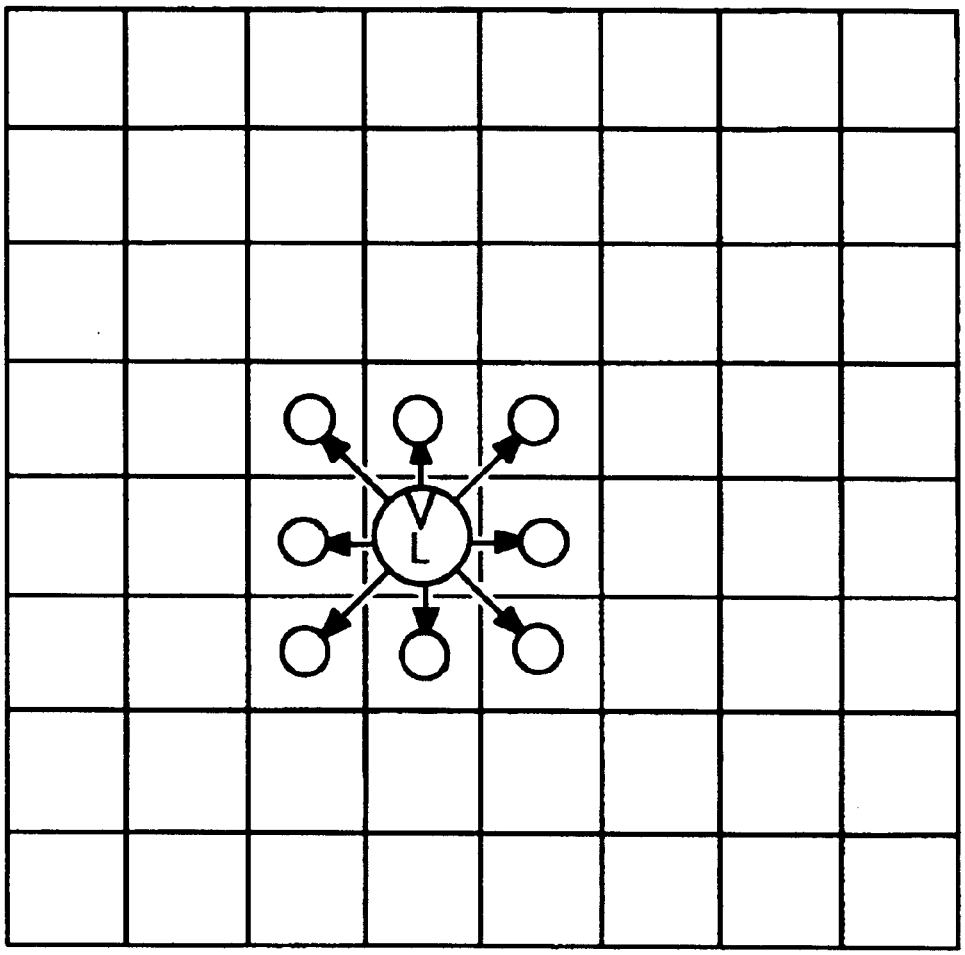
FIG. 8 illustrates the eight, standard, individual game piece movements of the Lion game piece, denoted by the "path" with arrows, "destination" of small circles, large circle representation for game piece origin and triangle registration mark on front the piece.
Figure 9:
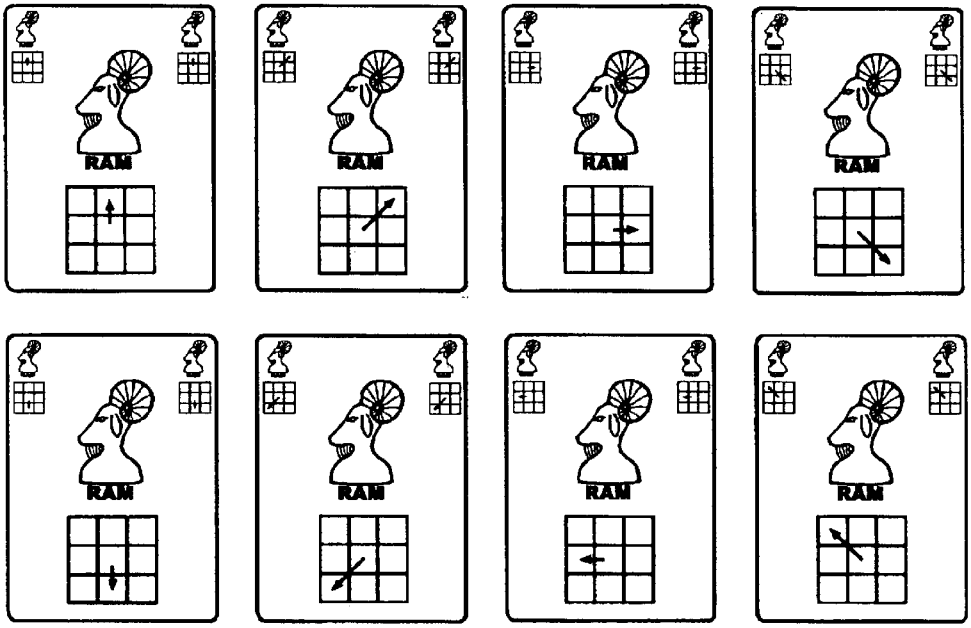
FIG. 9 illustrates one set of eight Additional Movement Cards for the Ram game piece, denoting the eight different additional movements offered, as referenced by the pointing arrow within the three-square by three-square grid on each card.
Figure 10:
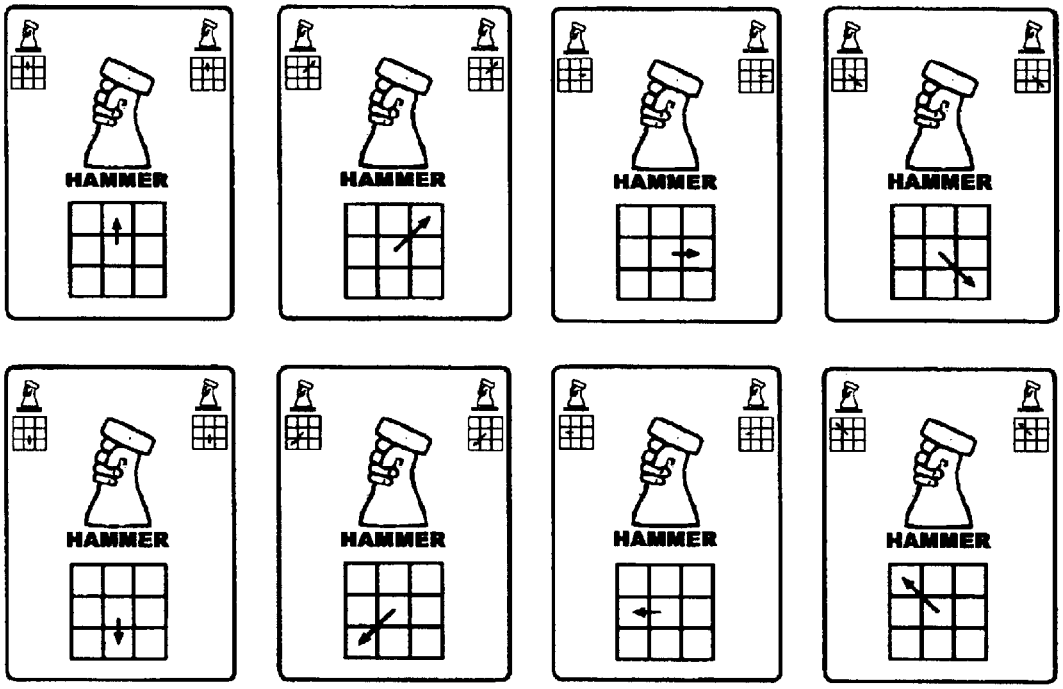
FIG. 10 illustrates the set of eight Additional Movement Cards for the Hammer game piece, denoting the eight different additional movements offered, as referenced by the pointing arrow within the three-square by three-square grid one each card.
Figure 11:
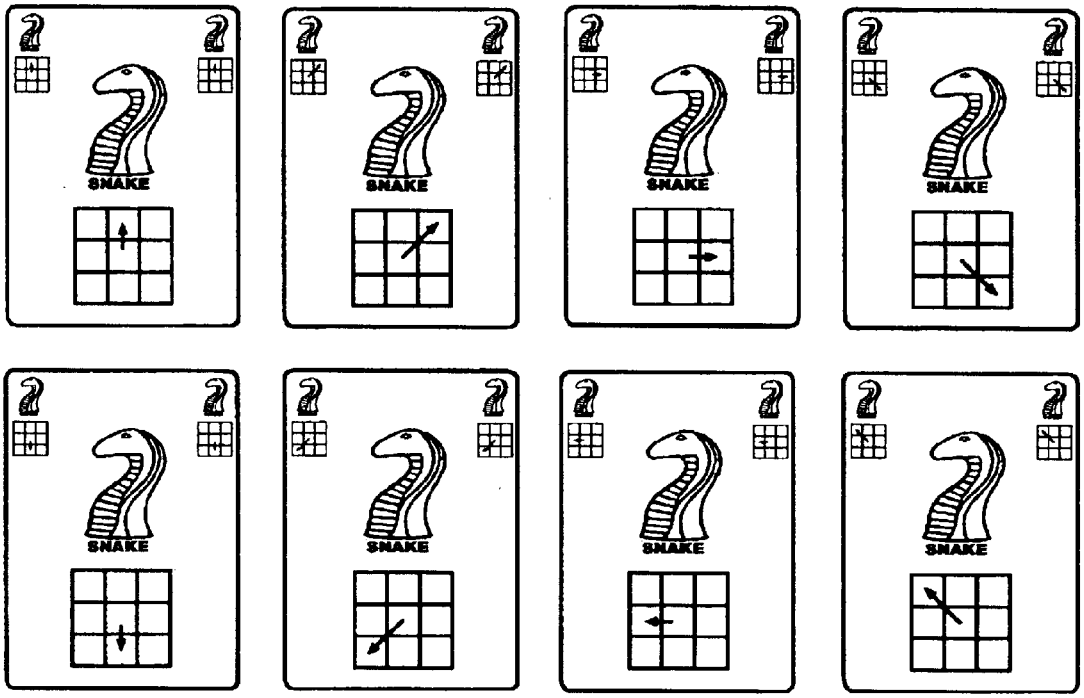
FIG. 11 illustrates the set of eight Additional Movement Cards for the Snake game piece, denoting the eight different additional movements offered, as referenced by the pointing arrow within the three-square by three-square grid on each card.
Figure 12:
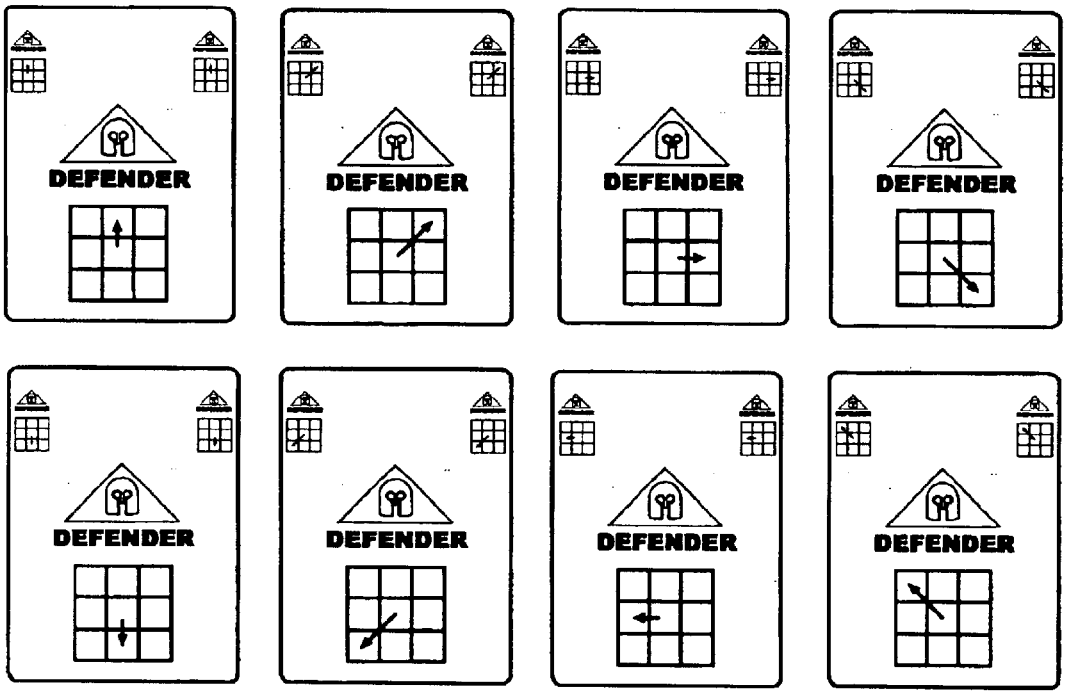
FIG. 12 illustrates the set of eight Additional Movement Cards for the Defender game piece, denoting the eight different additional movements offered, as referenced by the pointing arrow within the three-square by three-square grid on each card.
Figure 13:
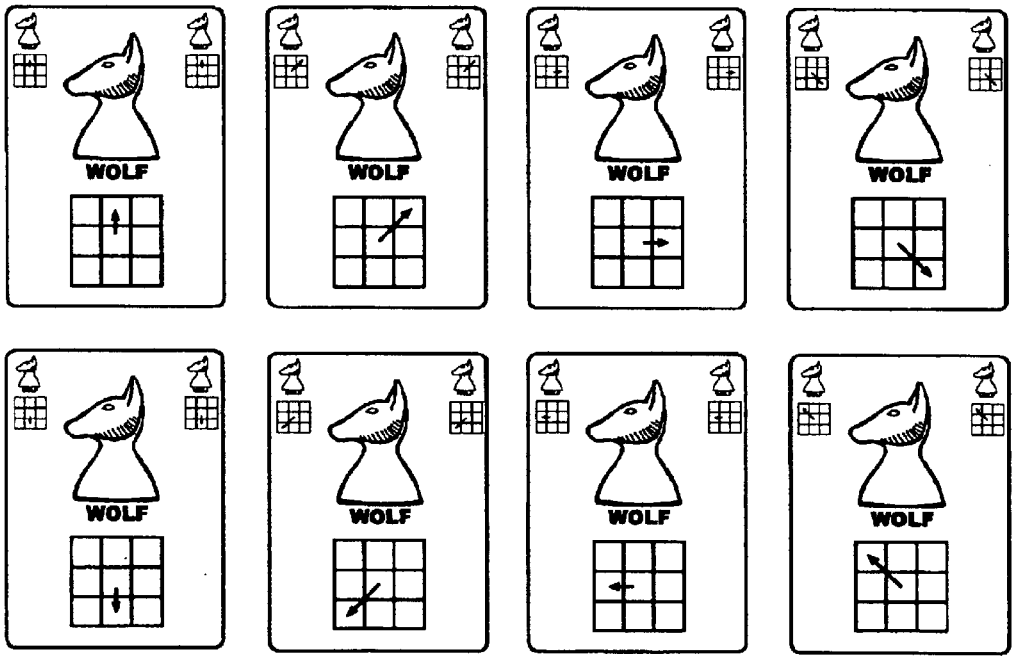
FIG. 13 illustrates the set of eight Additional Movement Cards for the Wolf game piece, denoting the eight different additional movements offered, as referenced by the pointing arrow within the three square by three square grid on each card.

Each game piece can have a front and a back as illustrated in FIG. 2, denoting the triangular shaped registration mark on the base of a Ram game indicating the front of said game piece. The attributes of each game piece are always oriented to the facing direction of said game piece, of which comprise the unique, standard movements of each game piece, as in FIGS. 3–8. Of all the game pieces, only the Lion and the Defenders can have the ability to move backwards, as shown in FIGS. 6 and 8. When a game piece is turned to face a different direction, all the attributes of that game piece can be turned so as to be oriented in the same direction as the game piece.

Figure 23:
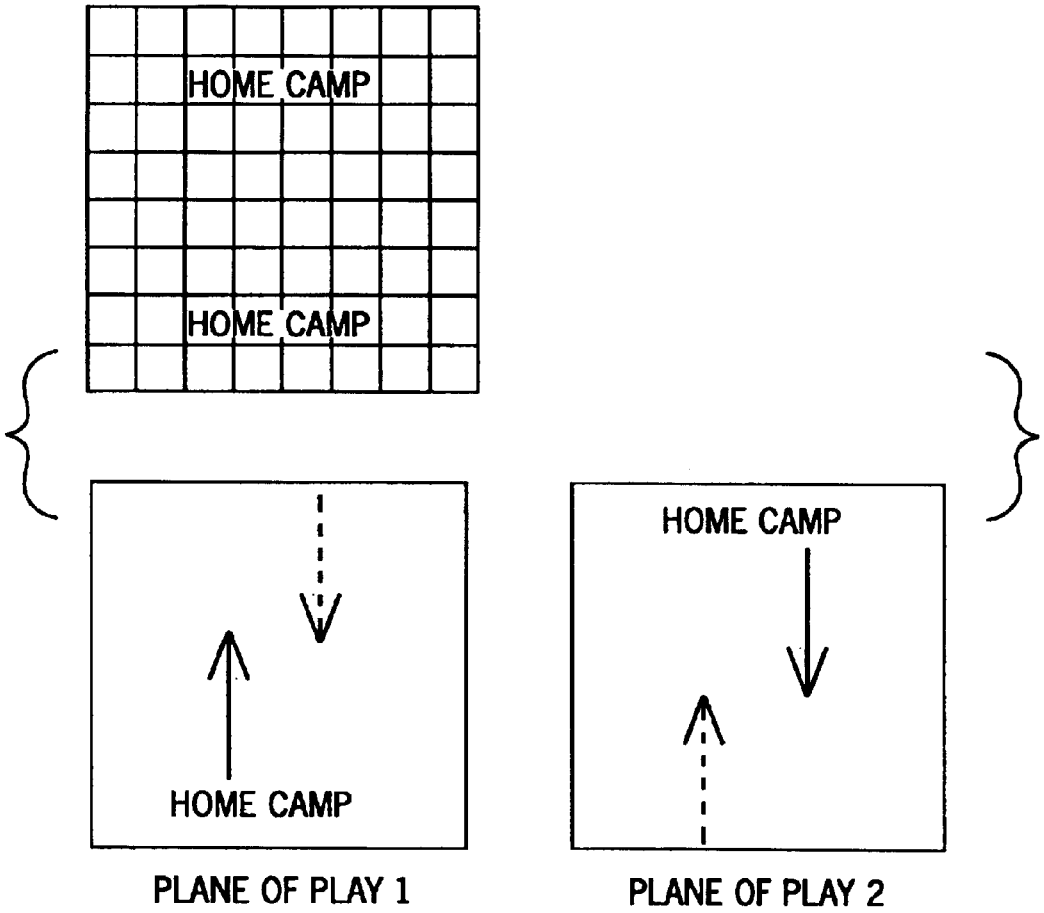
FIG. 23 illustrates the overlay concept for a two-player game board, denoting two Planes of Play a single game piece may travel, as illustrated by the solid arrow as the originating direction and the dashed arrow as the return direction.
Figure 24:
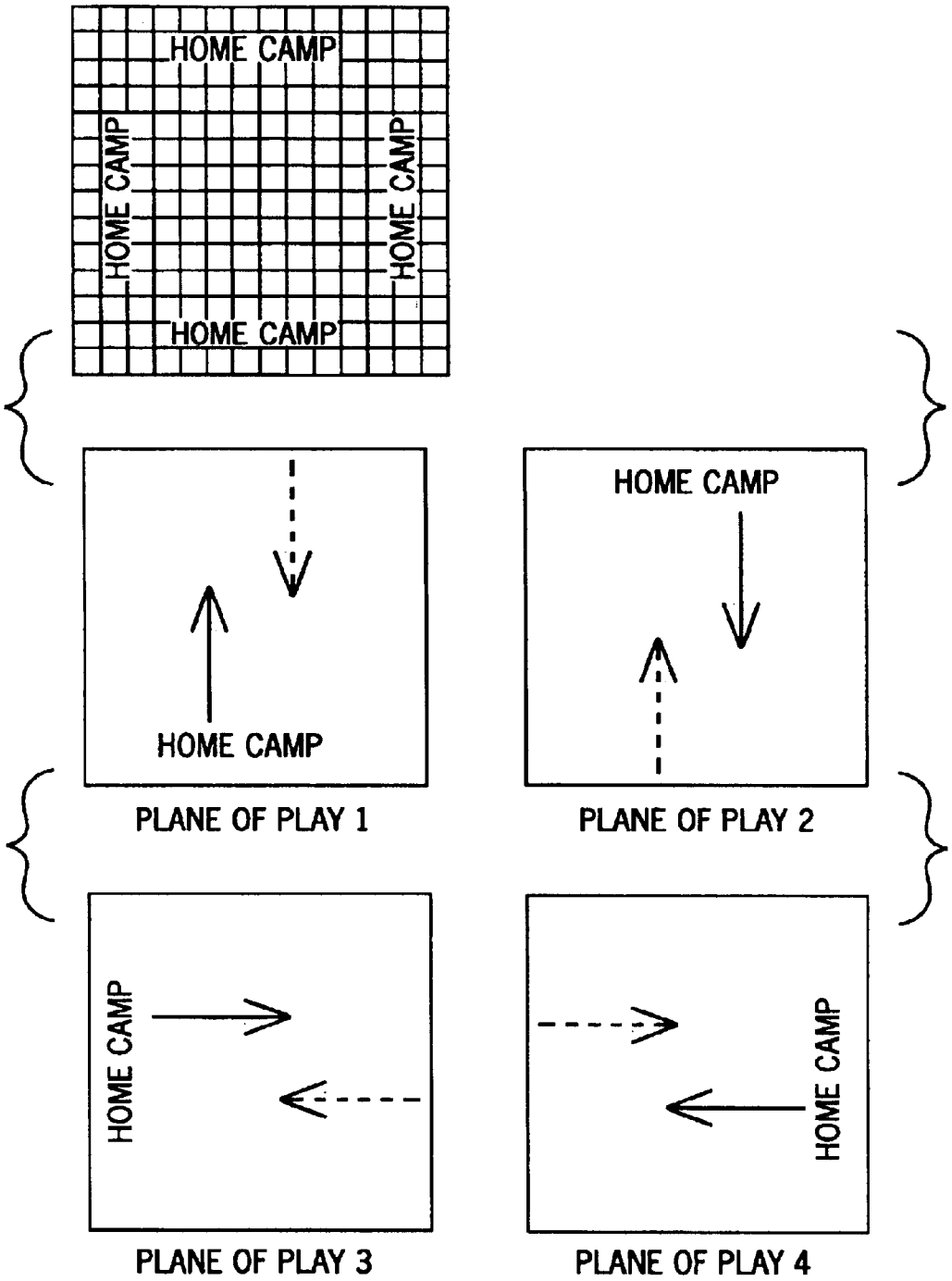
FIG. 24 illustrates the overlay concept denoting each of the four Planes of Play an individual player's game pieces may travel, as illustrated by the solid arrow as the originating direction and dashed arrow as the return direction.

The virtual layering of play aspects can now be used to explane the travel of direction oriented game pieces on a flat, single level, two dimension game board, whereas the game pieces travel on the same game board on overlapping layers of play, otherwise known as Planes of Play, as illustrated in FIGS. 23 and 24.

Each box containing arrows as illustrated in FIGS. 23–24 can represent the travel aspects of each individual player's game pieces whereas the solid arrow is the direction of travel of the player's game pieces as said game pieces travels away from Home Camp and the dashed arrow is the returning direction of the same player's game pieces.

Each of these noted boxes shall be termed as, Planes of Play. As denoted in FIG. 23, the two-player game board can have two Planes of Play; and the four-player game board can have four Planes of Play, as depicted in FIG. 24.

Figure 16A:
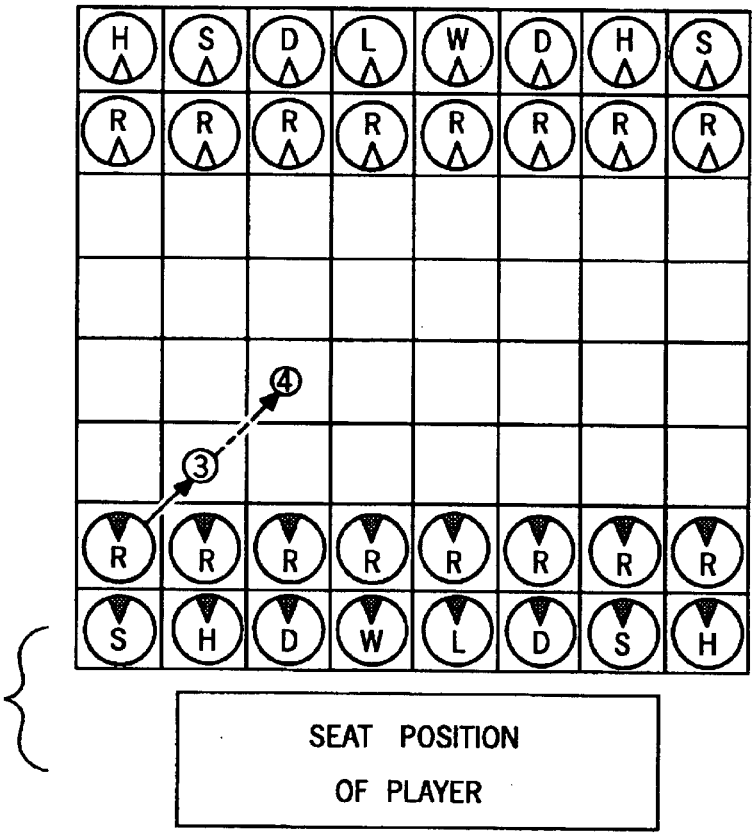
FIG. 16A is an enlarged view of the playing card in FIG. 16
Figure 16:
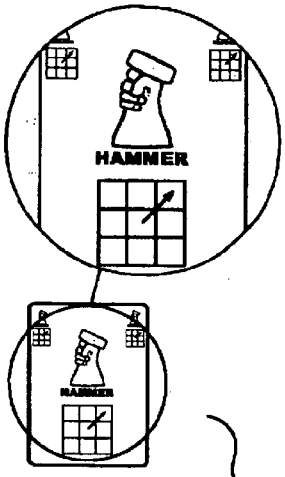
FIG. 16 illustrates the orientation of a playing card as referenced to the play board and the presenter.
Figure 17:
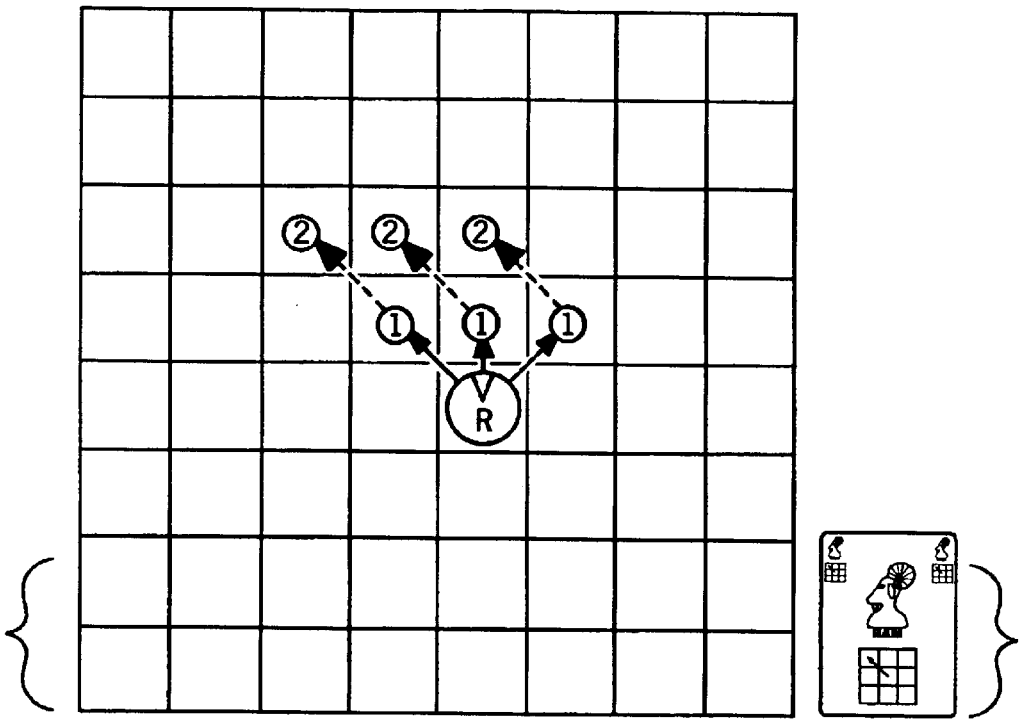
FIG. 17 illustrates the use of an Additional Movement Card for the Ram game piece, as it would be played, with the card movement, as in FIG. 9, played after the game piece movement, as in FIG. 3, denoting the circled number 1 as the possible standard game piece movement destinations, and the circled number 2 as the possible card movement destinations.
Figure 18:
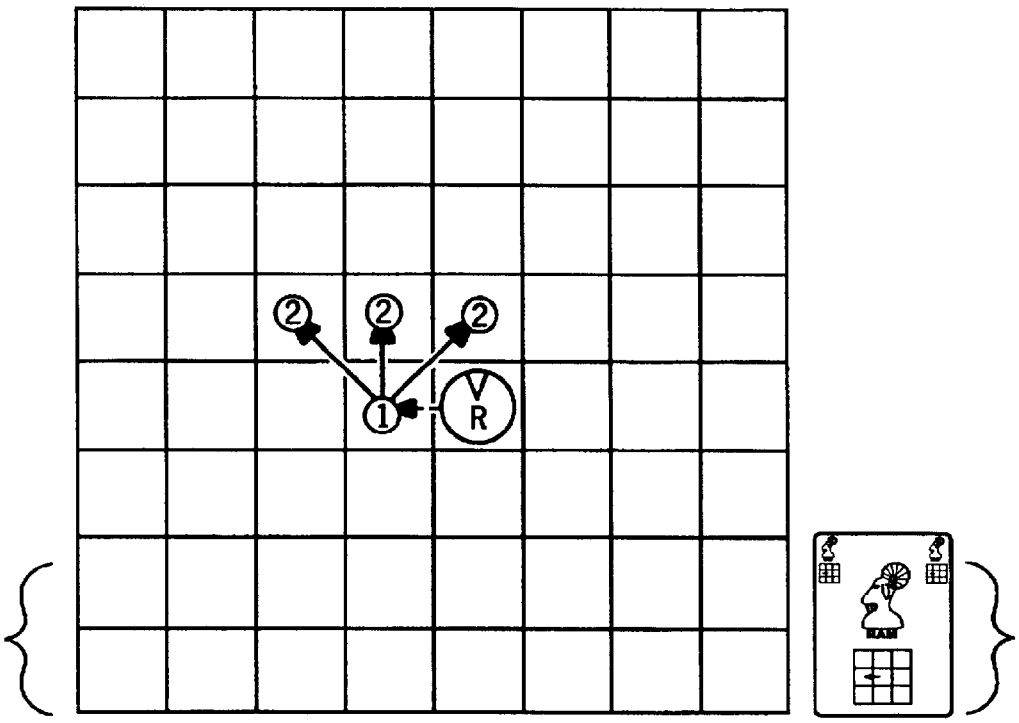
FIG. 18 illustrates the use of an Additional Movement Card for the Ram game piece, as reference, as it would be played, with the game piece movement, as in FIG. 3, played after the card movement, as in FIG. 9, denoting the circled number 1 as the possible card movement destination, and the circled number 2 as the possible standard game piece movement destinations.

The playing cards can always be played and oriented to the view of the player from his or her original seating position. By keeping the played cards oriented to the aspect of the player's view and originating seating position, all aspects of the card plays are easier to monitor by all players, as illustrated in FIG. 16.

The DiCon invention contains the element of chance and hidden strategy of up to approximately fifty Additional Movement Cards, whereby said cards are dealt and concealed, only to be revealed when a card is presented for an additional movement.

Forty-eight of the cards can have pictures, themes, or be exact facsimiles of five of the six different types of game pieces. The forty-eight cards can always be easily recognizable as to their counterpart game pieces.

Each type of game piece, except the Lion(Leader Game Piece) game piece, can be represented by eight cards, whereby each card of said eight indicates an additional single space movement in one of eight directions radiating from a central square of a three by three block grid.

The Ram game piece can have an additional set of eight Additional Movement Cards thereby increasing said Ram game piece effectiveness in the game.

All of the Additional Movement Cards as illustrated in FIGS. 9–15, except the Swap card, can represent an additional single square movement in one of eight directions, radiating from a central square.

An Additional Movement Card can be played when the player's turn comes and he or she sees the opportunity to use a card to extend the reach of one of his or her game pieces to capture an opponents game piece, as in FIGS. 17–21. The additional movement represented on the card, as in FIGS. 9–13 and 15, translates directly to the game piece square on the game board, as would be the central square of the grid of the presented card. The game piece can be moved as per the illustration on the card, to the square as indicated by the arrow. The card must be presented and laid to either side of the game board oriented to the view of the presenter, as in FIG. 16. Once the card is presented the player can make one of two choices:

1. Take the standard game piece movement first and then the additional movement as represented by the card; or 2. Take the additional movement as represented by the card and then the standard game piece movement, as illustrated in FIGS. 17, 18, 20, and 21.

The choices of taking one move before the other depends on whether the path to a destination square is blocked in one direction, but not the other. No game piece movement that involves the combination movements of an Additional Movement Card and a standard game piece movement shall be used in combination with a game piece rotation.

Figure 14:
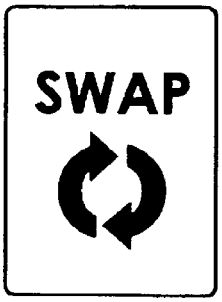
FIG. 14 illustrates the Swap card, denoting the opposing arrows, which represent the swapping of game pieces.
Figure 19:
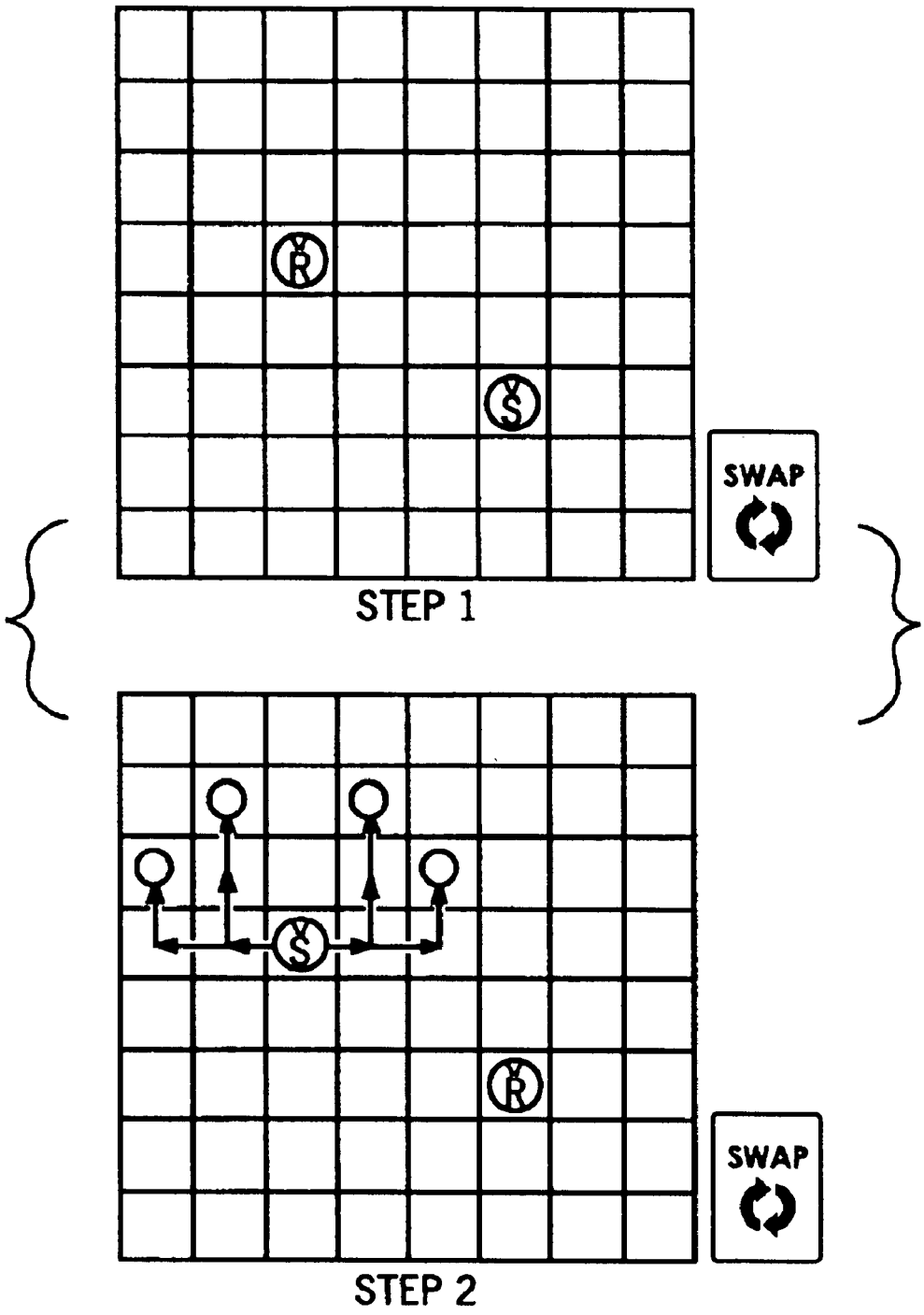
FIG. 19 illustrates the use of the Swap card, showing the two game pieces before the swap, as in step 1, and showing the four different standard movement destinations of the selected game piece, the Snake, after the swap, as referenced in step 2.

The Swap card, as shown FIG. 14, is an Additional Movement Card unlike the others, whereas the Swap card can be used to switch the position of two of his or her game pieces of the same color and make a standard movement with one of the switched game pieces, as in FIG. 19.

Figure 15:
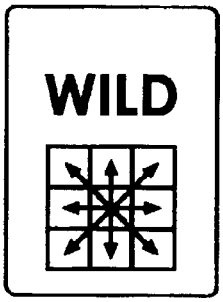
FIG. 15 illustrates the Wild card, denoting the eight different additional movements offered, as referenced by the pointing arrows within the three-square by three-square grid.
Figure 20:
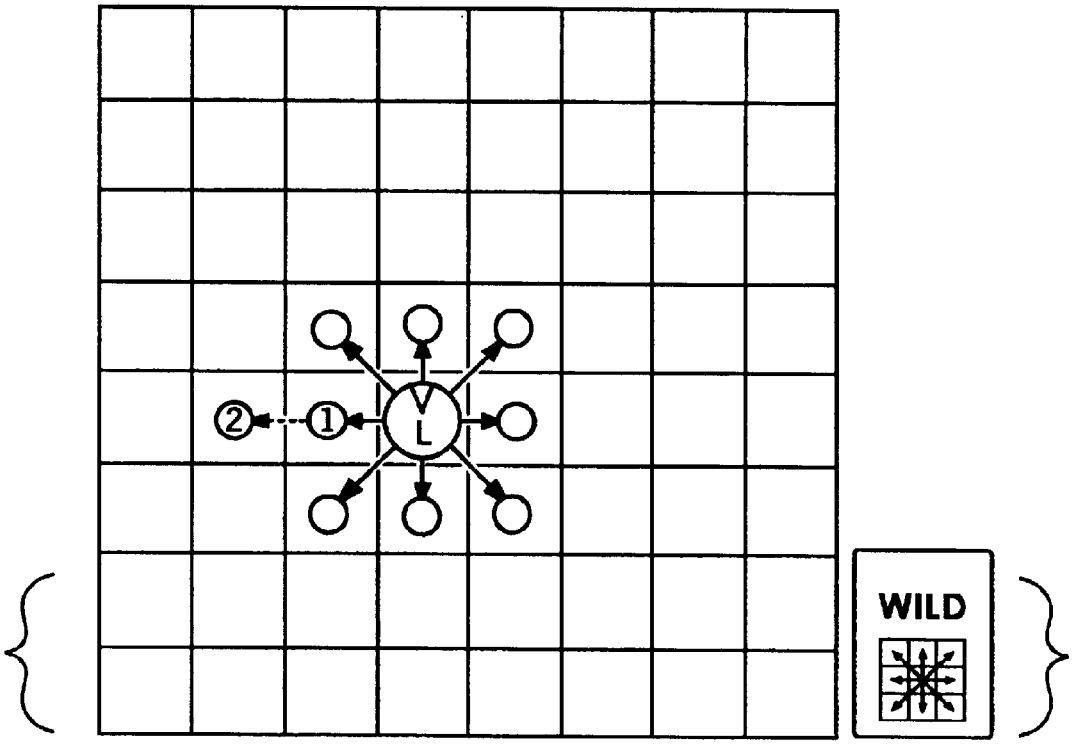
FIG. 20 illustrates the use of the Wild card in conjunction with one of the unique, standard movements of a Lion game piece, as reference, with one selected card movement destination, denoted by the circled number 2, taken after one selected, standard, game piece movement destination, denoted by the circled number 1.
Figure 21:
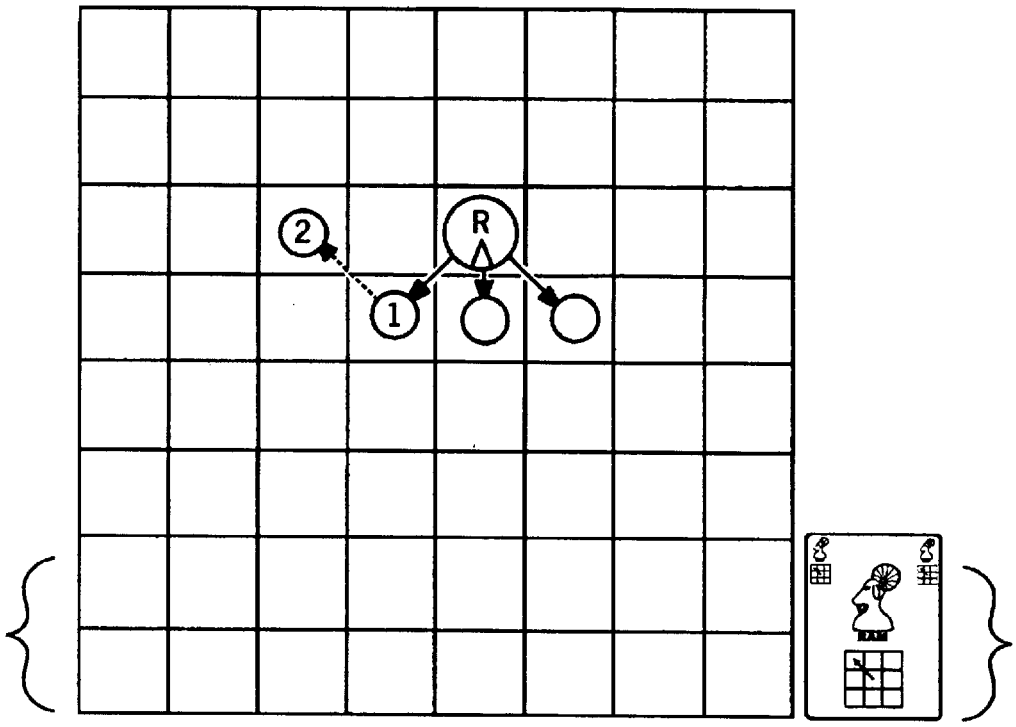
FIG. 21 illustrates the use of an Additional Movement Card for the Ram game piece, as reference, as it would be played after the game piece direction of travel has changed, showing the selected, standard, game piece movement destination, denoted by the circled number 1, and the card movement destination, denoted by the circled number 2.

The Wild card, as shown in FIG. 15, can be similar to the other Additional Movement cards whereas the Wild card can be used to extend the reach of any of his or her game pieces one square in a choice of one of eight directions, as in FIG. 20. In essence the Wild card can allow for directional movement in any direction.

The Swap card and the Wild card can be used with any game piece possessed by a player, and are the only cards that can be used with the Lion game piece.

Thus, the luck of the card deal determines, in great part, the strategy a player can and will formulate to capture game pieces and to win the game. Most DiCon invention game piece moves can be done without playing a card. However, using the cards makes playing the game more intriguing.

SECOND PREFERRED EMBODIMENT

Figure 22:
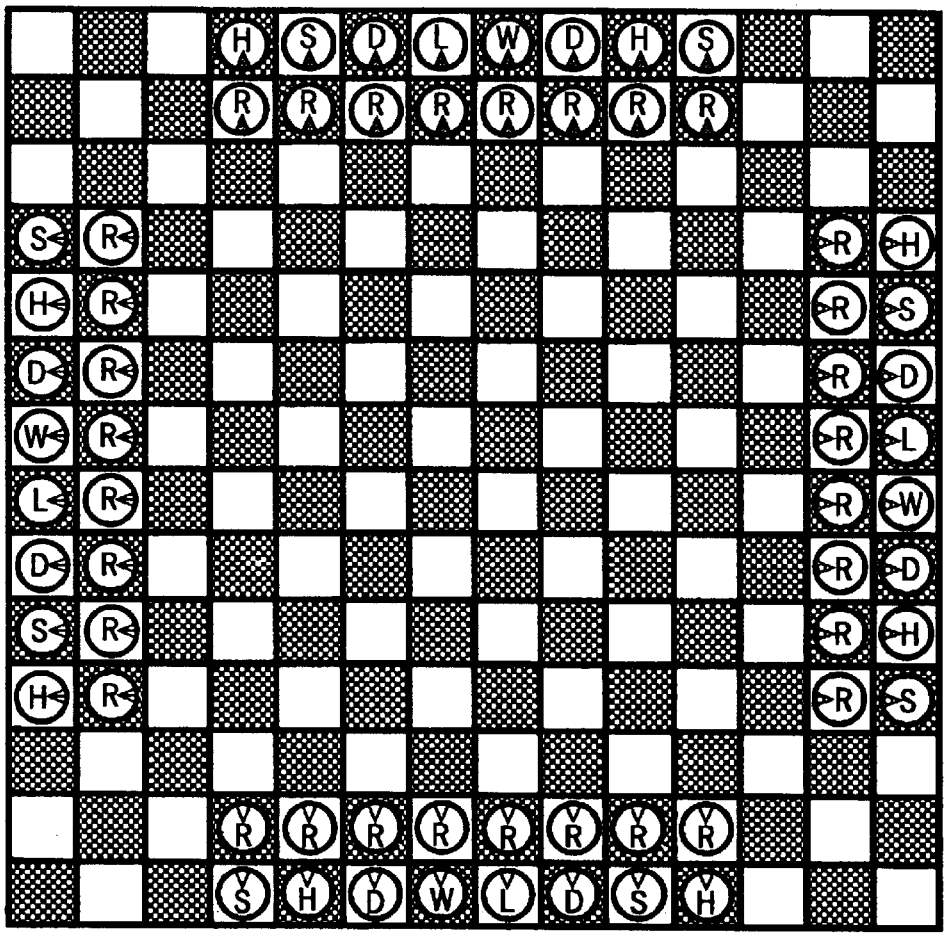
FIG. 22 is an overhead view of the four-player game board, illustrating the board setup for four players.

Referring to FIG. 22 the four-player game board can consist of one hundred, ninety-six equal sized squares of two alternating colors, arranged in fourteen columns and fourteen rows, thereby creating a checkered effect. The four-player game can also be played with two to four players. For example, two players can be given game pieces along two sides of the board.

The four-player game board setup allows for space between game pieces to the right and left of each Camp, as shown in FIG. 22. A four-player game has four virtual Planes of Play, which are used to explain the travel of direction oriented game pieces, as in FIG. 24. The four-player game board can have the sixteen game pieces(described in reference to the First Embodiment) for each player, whereas each set of sixteen is of a different color, thereby distinguishing each player's game pieces for their opponents' game pieces.

There can be two options of game play for the two-player game and three options of game play for the four-player game. Options for game plays must be agreed upon before game setup for new game starts. For advanced players of either the two-player or four-player game, an option exists to set up their game pieces, within their perspective camps, in any inward-facing arrangement they see fit, providing all players agree upon this option before a new game is started. For example game pieces can be set up on opposite sides from one another. More complex arrangements that will result in greater game skill and fun can have the game pieces of each player arranged along side edges perpendicular to one another.

If the before mentioned option is not chosen then the setup for a two-player game will be as illustrated in FIG. 1, and as in FIG. 22, for a four-player game. An option exists concerning the number of cards dealt for a two-player or four-player game, whereby said number is, seven or eleven cards dealt to each player. If a player has more cards, the game usually ends faster therefore this option of, seven or eleven cards, must be agreed upon before starting a new game.

Another option exists for a four-player game to play as Level Four Players, whereby any game piece that reaches the limits of the game board on any of the four sides, will be turned to face the inner part of the game board, thereby said game piece changes its Plane of Play and direction on travel, yet retains the game piece attributes as before. All players, before setup of a four-player game board, must agree upon the option of Level Four Play, or Level Four Play will not be an option for that new game.

Dealing of the cards can begin after game pieces have been arranged for the start of a new game and options have been agreed upon. All dealing of cards, thereafter the first card deal shall be done by alternating turns in a clockwise fashion. All cards are generally dealt face down. The dealer deals the cards out by starting with the player directly to his or her left and continues dealing in a clockwise fashion until the agreed number of cards has been dealt to each player. Each player then picks up his or her cards, concealing said cards from the other opponent or opponents.

A first player to move a game piece can be the player directly to the left of the dealer, or in the case of a two-player game, the player who did not deal. All moves thereafter continue in a clockwise alternating fashion around the game board. Most game piece movements can be made without the use of an Additional Movement Card. Standard movements can be used to position game pieces on the board whereby the next alternating turn may yield the opportunity to present a card and extend the reach of the game piece to capture an opponents game piece or win the game.

During a two player game or a four player game, a game piece will most likely reach the limits of the game board in the facing direction of the game, as the game piece travels in its facing direction; but not the limits of the game board to the left or right of the facing direction of the game piece. When the game piece reaches the limits in the facing direction, the game piece can be turned one hundred, eighty degrees to face the opposite direction.

During a four player Level Four Play, the game piece rotation shall include the rotation of the game piece when said game piece reaches the limits of the game board to the left or right. When this happens, as in Level Four Play, the game piece which reaches the limits of the game board will be turned to face inward toward the central part of the game board, rotating said game piece ninety degrees either clockwise or counter clockwise. This ninety degree rotating action, places the before mentioned game piece on a new Plane of Play and direction of travel.

If an Additional Movement Card is presented for use with a player's game piece residing on another plane of play, the Additional Movement Card can always be presented as viewed from the position of that player's seat position to the game board as said position was from the start of the game. The additional movement, as in the two-player game, represented on the card translates directly to the game piece square on the game board, as would be the central square of grid of the presented card. The game piece is moved as per the illustration on the card, to the square as indicated by the arrow.

The capture of another game piece can occur when the game piece of a player lands on the square occupied by an opposing player thereby displacing said opponent's game piece. The opponent's game piece is then removed from the game board.

During a four-player game, one player can conquer other players by capturing their Lion game pieces. When this happens, the conquered player relinquishes all of his or her game pieces and playing cards to the conqueror. The vanquished player is out of the game. The conquered game pieces remain in their positions. The conqueror at this point controls the conquered game pieces and takes the alternating turn of the conquered player as well as his or her own turn. The relinquished cards are added to the card hand of the conquering player and said cards may be used with either group of game pieces. If an Additional Movement Card is presented for use with a game piece residing on another plane of play, for either a Level Four Play or a conquered game piece play, the Additional Movement Card is always presented as viewed from the position of that player's seat position to the game board as said position was from the start of the game. A player shall never present a card from the viewed position that is not from his or her original seat position. The additional movement represented on the card translates directly to the game piece square on the game board, as would be the central square of grid of the presented card. The game piece is moved as per the illustration on the card, to the square as indicated by the arrow, as in FIGS. 17, 18, 20, 21. During a four-player game one player may control up to two conquered groups of game pieces and cards; and game pieces may reside on any of the four different Planes of Play.

With either the two-player game or four-player game, a win occurs when there is only one remaining Lion game piece left on the game board.

Figure 25:
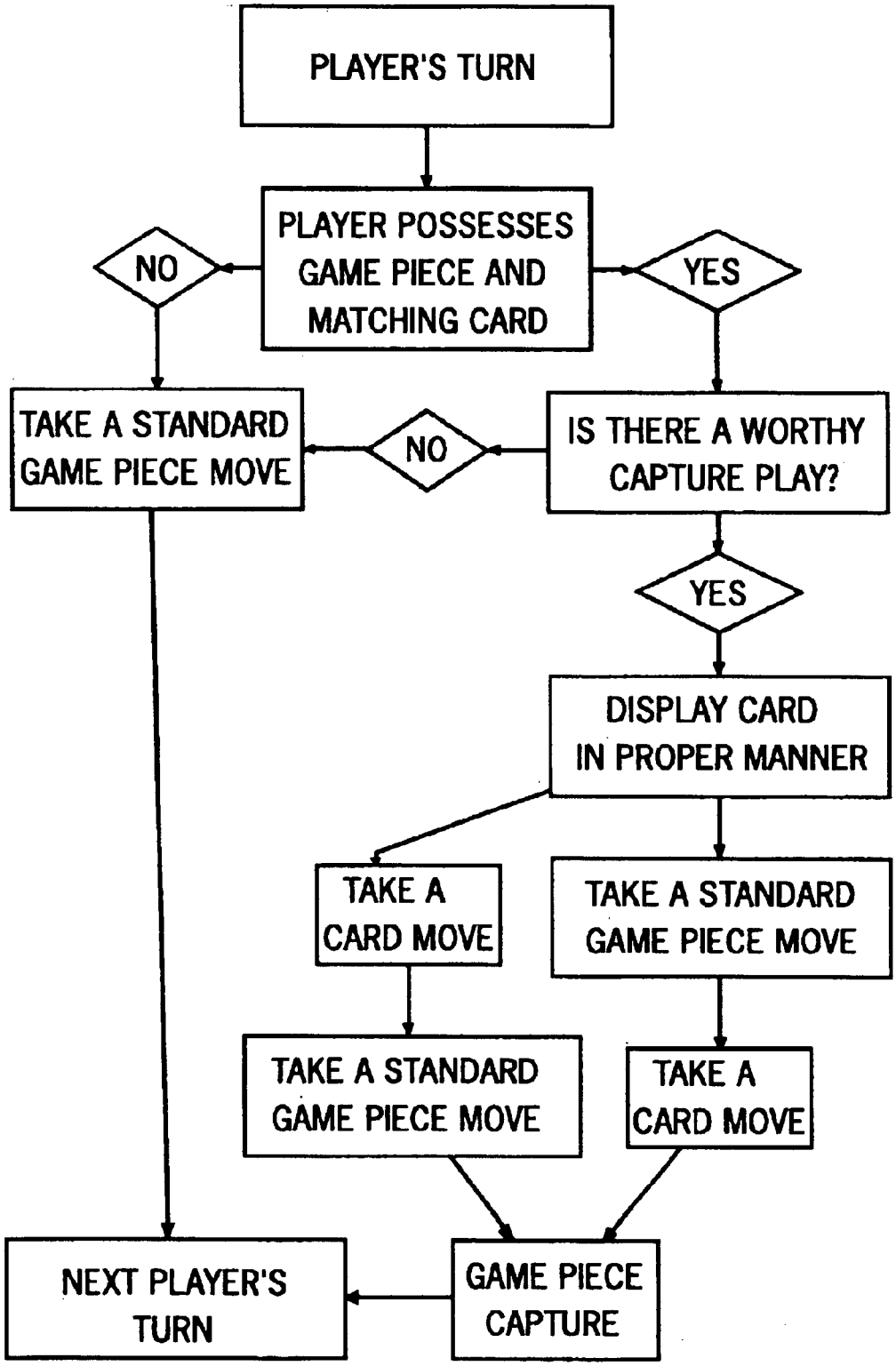
FIG. 25 is a flow chart detailing preferred steps for the novel invention game.

FIG. 25 is a flow chart detailing preferred steps for the novel invention game.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A game board apparatus for at least two players, comprising:

a board having a grid surface;

a first set of playing pieces arranged along a first side of the grid surface, each of the playing pieces of the first set having a first set of rules for moving the playing pieces;

a second set of playing pieces arranged along a second side of the grid surface, different from the first side, each of the playing pieces of the second set having a second set of rules for moving the playing pieces;

a plurality of cards, each of the cards denoting a third set of rules for moving the playing pieces; and a first player and a second player each being assigned one of the first set of playing pieces and the second set of playing pieces, and alternatively moving the first set and the second set of playing pieces according to the first set of rules, the second set of rules and the third set of rules, in order to capture and dispose of each others' playing pieces to win a game.

2. The game board apparatus of claim 1, wherein the grid surface is a chess board.

3. The game board apparatus of claim 1, wherein the grid surface is a checker board.

4. The game board apparatus of claim 1, wherein the grid surface is an eight by eight grid.

5. The game board apparatus of claim 1, wherein the first set of playing pieces and second set of playing pieces are identical to one another, and the first set of rules and the second set of rules are identical to one another, and the third set of rules is different from the first and the second sets of rules.

6. The game board apparatus of claim 1, wherein the first set of playing pieces and the second set of playing pieces includes:

a single leader piece; and plural additional pieces for protecting the single leader piece, wherein one player capturing the single leader piece of another player wins the game.

7. The game board apparatus of claim 6, wherein the single leader piece is a lion, and the plural additional pieces include eight ram pieces, two hammer pieces, two snake pieces, two defender pieces, and one wolf piece.

8. The game board apparatus of claim 1, wherein the plurality of cards includes:

cards corresponding to each of the first set of playing pieces and the second set of playing pieces; and means for revealing one card at a time during each turn of the first and the second players, wherein each of the revealed cards is a surprise to at least one of the players during the game.

9. The game board apparatus of claim 8, wherein the plurality of cards further includes:

a wild card for allowing anyone of the first set of playing pieces and the second set of playing pieces to move in all directions.

10. The game board apparatus of claim 8, wherein the plurality of cards further includes:

a swap card for allowing one of the first set of playing pieces or the second set of playing pieces to swap locations with one another within its respective set.

11. The game board apparatus of claim 1, further comprising:

rule means for reversing direction when one of the first set of pieces and the second set of pieces reaches a side edge of the grid surface.

12. The game board apparatus of claim 1, wherein the first side and the second side of the grid are on opposite sides of the grid to another.

13. The game board apparatus of claim 1, wherein the first side and the second side of the grid are perpendicular to one another.

14. The game board apparatus of claim 1, further comprising:

a third set of playing pieces arranged along a third side of the grid surface, each having a third set of rules for moving the third set of playing pieces;

a fourth set of playing pieces arranged along a fourth side of the grid surface, opposite to the third side, each having a fourth set of rules for moving the playing pieces; and a third player and a fourth player each being assigned one of the third set of playing pieces and the fourth set of playing pieces, and alternatively moving their playing pieces according to the third set of rules, the fourth set of rules and the third set of rules along with the first player and the second player, all in order to capture and dispose of each others playing pieces to win the game.

15. The game board apparatus of claim 14, wherein the grid surface includes:

a fourteen by fourteen grid.

16. A method of playing a board game comprising the steps of:

providing a game board having a grid surface;

positioning a first set of player pieces along a first side of the board for a first player;

positioning a second set of player pieces along a second side of the board different from the first side for a second player;

providing a main set of rules for directionally moving both the first set of player pieces and the second set of player pieces on the grid surface;

dealing cards to both the first player and the second player;

providing an additional set of rules based on the cards for directionally moving both the first set of player pieces and the second set of player pieces on the grid surface;

alternating play between the first and the second player; and selecting one card at a time during the play;

moving each playing piece of the first set of playing pieces and the second set of playing pieces dependent upon a combination of the main set of rules and the additional set of rules; and continuing the game according the alternating play and the main rules and the additional rules until one of the players wins.

17. The method of claim 16, wherein the steps of dealing and selecting include the steps of:

dealing the cards face down to both players; and revealing the one card at a time during the play, wherein the card is a surprise to at least one of the players.

18. The method of claim 16, wherein the step of continuing the game includes the step of:

winning the game when a leader playing piece of one of the first set of player pieces and the second set of player pieces is captured.

19. The method of claim 16, further comprising the step of:

allowing for any directional movement of one of the first set of playing pieces and the second set of playing pieces when a wild card is revealed during the game.

20. The method of claim 16, further comprising the step of:

swapping position locations between one of the first set of playing pieces or one of the second set of playing pieces within its respective set, when a swap card is revealed during the game.

21. The method of claim 16, further comprising the step of:

reversing direction of one of the first set of playing pieces and one of the second set of playing pieces when the one has reached a side edge of the grid surface.

22. The method of claim 16, wherein the main set of rules and the additional set of rules are different from one another.

23. The method of claim 16, further comprising the step of:

providing an eight by eight grid surface.

24. The method of claim 16, further comprising the step of:

positioning a third set of player pieces along a third side of the board for a third player;

positioning a fourth set of player pieces along a fourth side of the board opposite to the third side for a fourth player, directional movement rules of the third set of player pieces and the fourth set of player pieces being covered by the main set of rules;

dealing the cards having the additional directional movement rules face down to the first player and the second player, the third player and the fourth player;

alternating play between the first, the second, the third and the fourth players;

revealing the one card at a time during the play, wherein exposure of the additional rules on the card is a surprise to at least one of the players;

moving each playing piece of each of the first, the second, the third and the fourth player dependent upon a combination of the main set of rules and the additional set of rules; and continuing the alternating play with the main rules and the additional rules until a single leader playing piece of one of the players remains in the game.

25. The method of claim 24, wherein the grid surface includes: a fourteen by fourteen grid surface.

26. The method of claim 16, wherein the first side and the second side of the grid surface are perpendicular to one another.

27. The method of claim 16, wherein the first side and the second side of the grid surface are opposite to one another.

* * * * *